US006983876B1

(12) United States Patent
Hauser

(10) Patent No.: US 6,983,876 B1
(45) Date of Patent: Jan. 10, 2006

(54) TOOL SEIZING APPARATUS FOR DETERRING VANDALS

(76) Inventor: Ray L. Hauser, 5758 Rustic Knolls Dr., Boulder, CO (US) 80301

( * ) Notice: Subject to any disclaimer, the term of this patent is extended or adjusted under 35 U.S.C. 154(b) by 38 days.

(21) Appl. No.: 10/862,297

(22) Filed: Jun. 7, 2004

(51) Int. Cl.
*B65D 91/00* (2006.01)

(52) U.S. Cl. ..... 232/38; 232/39

(58) Field of Classification Search ..... 232/38, 232/39, 17; 248/551, 146, 156
See application file for complete search history.

(56) References Cited

U.S. PATENT DOCUMENTS 4,368,842 A * 1/1983 DeLange, III ..... 232/17
4,955,533 A * 9/1990 Merkel ..... 232/39
5,208,085 A * 5/1993 Pace ..... 428/43
5,356,072 A * 10/1994 Thomas ..... 232/39
5,435,483 A * 7/1995 Cox ..... 232/38
5,460,326 A 10/1995 Albanesius
5,575,422 A * 11/1996 Peterman ..... 232/38
D385,679 S 10/1997 Sullivan

* cited by examiner

*Primary Examiner*—William L. Miller
(74) *Attorney, Agent, or Firm*—David Kiewit

(57) ABSTRACT

A bat trap provides for capturing a bat, club, or other tool or weapon used by a vandal to damage a mailbox adjacent a roadway. The trap may comprise an elongated support member; a plurality of spikes protruding through the support member from a back side of the support member so that a respective point of each spike extends outwardly from the support member by some selected minimum distance; a cover extending far enough from the support so as to cover all of the spikes; and an adhesive or mechanical fastener for attaching the support member to the mailbox so that the back side of the support abuts a traffic-facing side of the mailbox.

8 Claims, 3 Drawing Sheets

TOOL SEIZING APPARATUS FOR DETERRING VANDALS

BACKGROUND OF THE INVENTION

1. Field of the Invention

The invention relates to apparatus and method for deterring vandalism by seizing a vandal's tool or weapon, such as a baseball bat used to damage or destroy roadside mailboxes.

2. Background Information

"Mailbox baseball" is a form of vandalism in which a passenger in a vehicle leans out and swings a bat at a mailbox as the car drives along the road, scoring if he hits the mailbox. Rural mailboxes are particularly susceptible to such vandalism, but the problem sometimes occurs in urban neighborhoods where the mailboxes are placed at curbside. Numerous inventors, handymen, and mailbox manufacturers have addressed this problem by providing impact-resistant mailboxes, and resilient or strengthened mailbox supports.

Albanesius, in U.S. Pat. No. 5,460,326, and Sullivan in U.S. No. Des 385,679, both show devices for protecting a post-mounted mail box against snow plow debris and vandalism. These devices are generally supported by the post and comprise an upstanding protective wall portion facing oncoming traffic.

BRIEF SUMMARY OF THE INVENTION

A preferred embodiment of the invention comprises bat trap apparatus for capturing a bat, club, or other tool or weapon being used by a vandal to damage a mailbox disposed adjacent a roadway. The apparatus may comprise an elongated support member; a plurality of spikes protruding through the support member from a back side of the support member so that a respective point of each spike extends outwardly from the support member by some selected minimum distance; a cover extending far enough from the support so as to cover all of the spikes; and an adhesive or mechanical fastener for attaching the support member to the mailbox so that the back side of the support abuts a traffic-facing side of the mailbox.

In one embodiment of the invention the cover is a frangible or easily pierced semi-cylindrical shell attached directly to the support so as to protect a user of the mailbox or a casual passerby from being injured by contact with the spikes. In this embodiment, when the vandal's bat impacts the bat trap, the cover shatters or is pierced by the spikes so that the bat can bear on and be captured by those spikes.

In another embodiment the cover comprises a polymeric foam body extending from a front side of the support so as to completely cover all of the spikes and protect conventional users of the mailbox from accidental injury. In this embodiment, when the vandal's bat impacts the bat trap, the foam deforms so that the bat can be captured by the spikes.

Although it is believed that the foregoing rather broad recital of features and technical advantages may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed herein as a basis for designing other arrangements for carrying out the same purposes of the present invention. Those skilled in the art will realize that such equivalent constructions are within the spirit and scope of the invention in its broadest form. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

In studying this Detailed Description, the reader may be aided by noting definitions of certain words and phrases used throughout this patent document. Wherever those definitions are provided, those of ordinary skill in the art should understand that in many, if not most instances, such definitions apply to prior, as well as future uses of such defined words and phrases. At the outset of this Description, one may note that the terms "include" and "comprise," as well as derivatives thereof, mean inclusion without limitation; the term "or," is inclusive, meaning and/or; the word "bat" stands for any sort of elongated tool or weapon usable by a vandal to smash a mailbox and shall include, but not be limited to, such implements as a baseball bat, a club or mace, a stick, a piece of lumber, an ax, a sword, or a hammer; the word "post" shall stand for any sort of vertically extensive ground anchoring support for a mailbox and shall include without limit such things as a conventional lumber post, a concrete or stone pillar and a metal structural element; and the phrase "bat trap" shall denote a means for engaging and holding a vandal's bat or other implement that forcibly impacts it, the trap including, but not limited to, mechanical arrangements for piercing the bat, mechanical arrangements for entrapping the bat, adhesives, and combinations of various such individual trapping or seizing means; "spike" shall denote any sort of sharp, upstanding pointed metallic object without limitation as to its suitability for use as a wood fastener.

Figure 1:
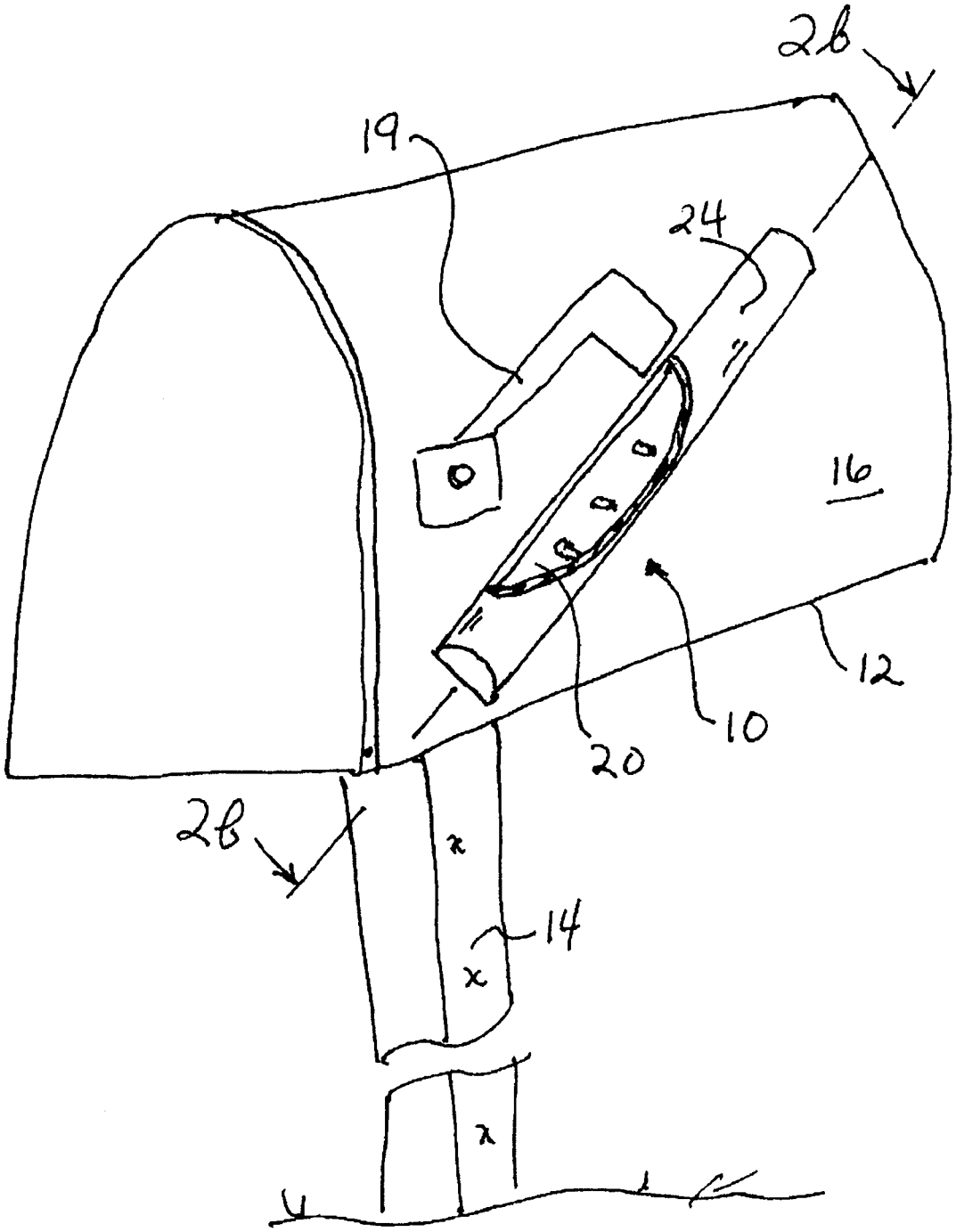
FIG. 1 is a partly cut-away view of a bat trap of the invention attached to a side of a mailbox.

Turning now to FIG. 1, one finds a bat trap 10 of the invention attached to a mailbox 12 of the sort that is ordinarily mounted on a post 14 along a roadway. As is conventional, the mailbox 12 has a traffic-facing side 16 with a flag 19 movably attached to it. This traffic-facing side of the mailbox is commonly the target of a bat-swinging vandal in a moving car. Hence, the bat trap 10 is generally attached to the traffic facing side of the mailbox. The reader will realize that in some circumstances a vandal's attack can be launched against a top of the box—e.g., when the vandal is on foot. If such an assault is deemed likely, one can, select another portion of the exterior surface of the mailbox for protection and install a bat trap so as to protect that selected portion of the mailbox instead of, or in addition to, the traffic-facing side.

A preferred bat trap 10 of the invention comprises a plurality of spikes 18 arrayed pointing away from the mailbox toward the presumed direction of attack. The spikes 18 are preferably held in position by a suitable support member 20. The support member may be a piece of wood through which the spikes have been nailed, or a piece of plastic into which separate spikes have been molded. In one preferred embodiment, the spikes are commercially available drywall ring shank nails having a tip radius of 0.010 inches, a tapered point having an included angle of about 15° and rings about 0.110 inch in diameter spaced along a 0.098" shank at a spacing of one ring every 0.040 inches. The reader will recognize that many other approaches may be taken to provide an array of spikes and that these include, but are not limited to forming an array of metal spikes by making multiple cuts into a strip of metal and then bending the spikes so as to be generally perpendicular to the strip.

Figure 2A:
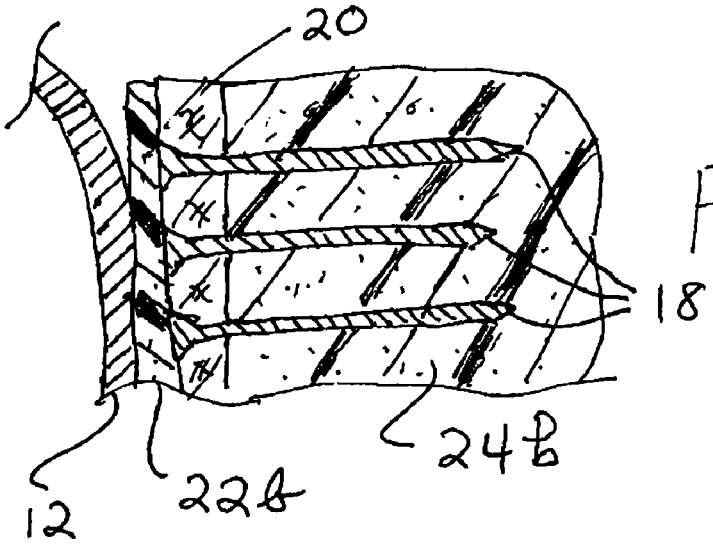
FIG. 2*a* is a cross-sectional view of an embodiment of a bat trap of the invention attached to a mailbox.
Figure 2B:
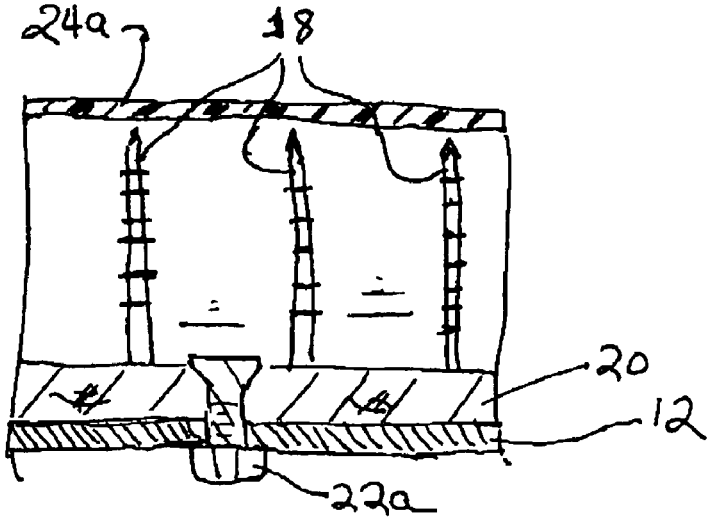
FIG. 2*b* is a cross-sectional view of the bat-trap of FIG. 1, the view taken as shown by the line 2*b*—2*b*.
Figure 3:
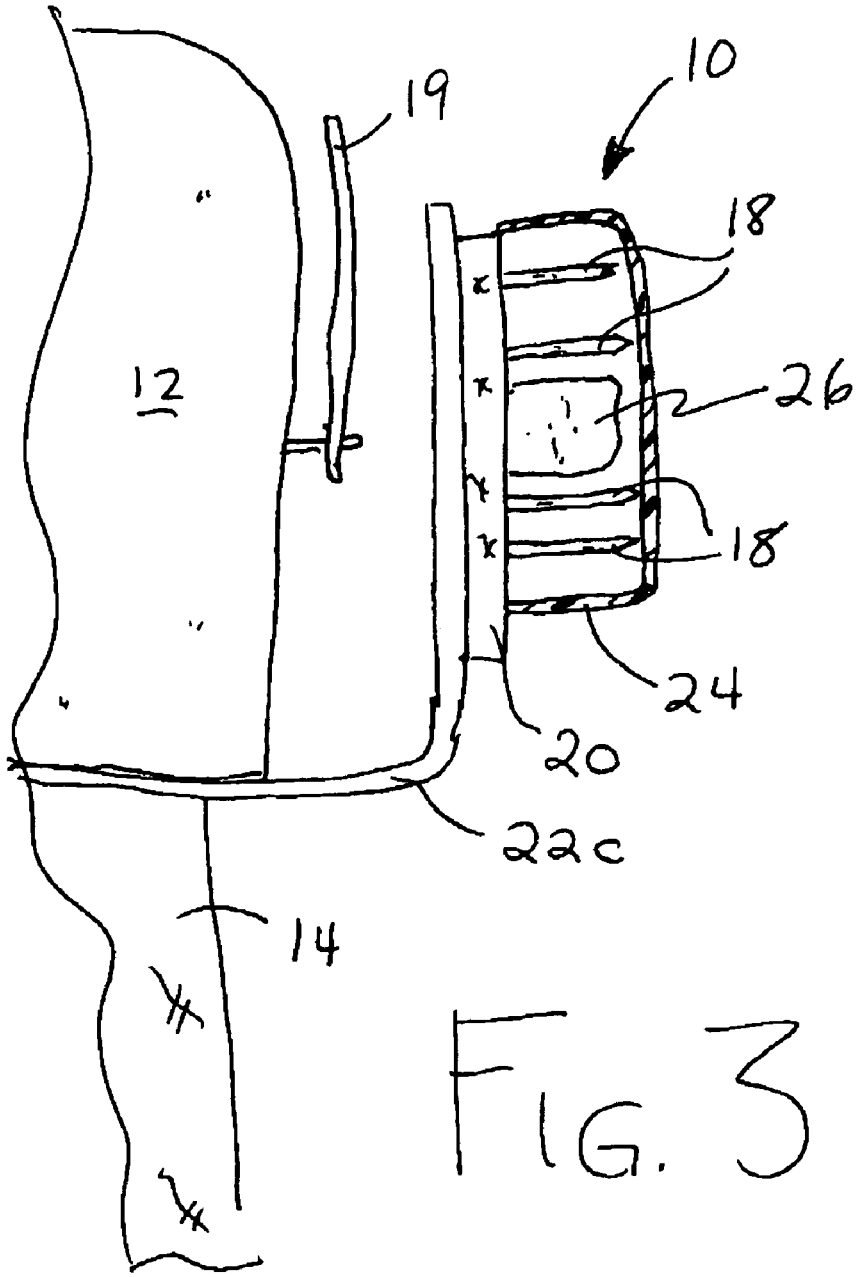
FIG. 3 depicts an alternate mounting of the bat trap of the invention.

The array of spikes can be affixed to a mailbox by supplying a suitable fastener 22 to attach a back side of the support member outward of and adjacent to the protected portion of the exterior surface of the mailbox. In some embodiments the fastener 22 comprises a mechanical fastener, such as the bolt 22*a* depicted in FIG. 2*b*. In other cases the fastener may be an adhesive, such as the adhesive-backed foam strip 22*b* depicted in FIG. 2*a*. In still other embodiments, such as the one depicted in FIG. 3, the fastener may comprise an L-shaped metal piece 22*c* directly connected to the post 14 so as to space the array of spikes 18 away from the protected, traffic-facing side 16 of the mailbox 12. An arrangement of this sort may be chosen, for example, both to provide additional physical protection to the mailbox and to allow unrestricted use of the mailbox flag 19.

A bare array of spikes projecting outwardly from a mailbox would clearly constitute a hazard to anyone using the mailbox or accidentally brushing against it. To avoid injury to innocent parties, as well as to provide a means of protecting metal spikes from weathering, a preferred bat trap 10 of the invention comprises a cover 24 disposed over the array of spikes 18. In some embodiments the cover may be a frangible plastic, glass, or ceramic tube 24*a*, such as a semi-cylindrical piece of acrylic plastic. In one embodiment, the cover is a polyethylene tube having a wall that is approximately 0.060 inches thick and that can be easily pierced by the spikes upon a hard impact. In other cases the cover may be a polymeric foam body 24*b* formed over the spike array. The reader will recognize that many other sorts of frangible or deformable covers are possible. Moreover, the cover may be selectively painted, or otherwise colored so as to either be camouflaged or, alternately, to present a high visibility light reflective surface to serve as a warning to a prospective vandal.

When the bat trap of the invention is struck by a vandal's bat, the spikes grab the bat out of the hand of the vandal while his vehicle is still moving. This may prompt the vandal to abandon the bat, or may lead him or her to return for the bat at the risk of being identified by the property owner.

An alternative embodiment of this deterrent incorporates a signaling device 26, which may be a small pyrotechnic 'flash-bang' device placed so that it is directly triggered by the impact of a bat. Alternately, the signaling device may be located in a relatively protected portion of the bat grabber 10 and configured to signal the mailbox owner by radio, light beam, or other known remote signaling means.

EXAMPLES

Example 1

A bat grabber was made using a piece of ¾" oak as the rigid support plate 20. Six drywall screws (size #6×1.5") were ground to remove threads from the ½" tip of the *screws*, but no effort was made to make their tips any sharper than as *purchased*. *These* screws were placed in the wood at 1-inch intervals, and were covered with polyolefin foam to cover the tips of the screws. This device was mounted on the side of a mailbox using both 3 M #5952 double-sticky foam tape and a mechanical fastener. Upon impact with a baseball bat from a vehicle traveling at 20 mph, the bat broke one or more of the brittle screws and was not grabbed out of the hand of the bat-holder.

Example 2

A similar bat grabber was made using a piece of ½" plywood as the rigid plate. Six unmodified drywall nails were driven through the plywood at 1" intervals. These were Grip Tite™ Bright Ring Shank nails from Prime Source Building Products, Inc., Dallas Tex.; they were 1⅝" long, 0.095" diameter with sharp tips. The nail tips were covered with polyolefin foam. Upon impact with a ball bat, one or more nails became embedded in the bat and the bat was grabbed tightly enough that a pry bar was needed to remove the bat from the nails.

Example 3

A bat grabber was made using a piece of Simpson Strong-Tie MP-14 attached to ½" plywood. This sheet metal item had prongs or spikes about 0.33 inch long made by a cutting and stamping a sheet of galvanized steel that was 0.035" thick. This material sometimes grabbed the bat, and sometimes did not. Longer and sharper prongs would probably be effective for this system, which has the advantage of easy production and low cost Although the present invention has been described with respect to several preferred embodiments, many modifications and alterations can be made without departing from the invention. Accordingly, it is intended that all such modifications and alterations be considered as within the spirit and scope of the invention as defined in the attached claims.

I claim:

1. An apparatus comprising, in combination:

a post for supporting a mailbox at a selected distance above a surface of the earth and adjacent a roadway;

the mailbox having a portion of an exterior surface selected for protection, and a signaling device; and a bat trap for engaging an impacting object, the bat trap comprising a plurality of spikes extending outwardly from the surface portion selected for protection so that a respective point of each spike is distal from the mailbox, and a cover disposed over the spikes.

2. The apparatus of claim 1 wherein the cover is a foam body disposed about the spikes.

3. The apparatus of claim 1 wherein the cover is a frangible housing disposed about the spikes.

4. The apparatus of claim 1 wherein the cover is an easily pierced housing disposed about the spikes.

5. The apparatus of claim 1 wherein the cover is a housing having a camouflaged surface.

6. The apparatus of claim 1 wherein the cover is a housing having a high visibility light reflecting surface.

7. The apparatus of claim 1 wherein the bat trap is directly connected to the surface portion of the mailbox by one of an adhesive and a mechanical fastener, the surface portion being the traffic-facing side of the mailbox.

8. An apparatus comprising, in combination:

a post for supporting a mailbox at a selected distance above a surface of the earth and adjacent a roadway;

the mailbox having a portion of an exterior surface selected for protection, and a signaling device;

an L-shaped member directly connected to the post; and a bat trap for engaging an impacting object, the bat trap comprising a plurality of spikes extending outwardly from the L-shaped member so that a respective point of each spike is distal from the mailbox, and a cover disposed over the spikes.

* * * * *